US009926110B2

(12) United States Patent
Treadwell

(10) Patent No.: US 9,926,110 B2
(45) Date of Patent: Mar. 27, 2018

(54) SHOTGUN SHELL NOVELTY CADDY

(71) Applicant: Juanita Treadwell, Mesita, CO (US)

(72) Inventor: Juanita Treadwell, Mesita, CO (US)

( * ) Notice: Subject to any disclaimer, the term of this patent is extended or adjusted under 35 U.S.C. 154(b) by 197 days.

(21) Appl. No.: 14/985,322

(22) Filed: Dec. 30, 2015

(65) Prior Publication Data

US 2017/0036813 A1 Feb. 9, 2017

Related U.S. Application Data

(60) Provisional application No. 62/201,482, filed on Aug. 5, 2015.

(51) Int. Cl.

| | |
|---|---|
| ***B65D 75/00*** | (2006.01) |
| ***B65D 43/02*** | (2006.01) |
| ***B65D 81/36*** | (2006.01) |

(52) U.S. Cl.

CPC ..... *B65D 43/0225* (2013.01); *B65D 43/02* (2013.01); *B65D 81/365* (2013.01)

(58) Field of Classification Search

USPC ..... 206/457, 443, 446

See application file for complete search history.

(56) References Cited

U.S. PATENT DOCUMENTS

| | | | | |
|---|---|---|---|---|
| 7,422,102 | B1 * | 9/2008 | Lam | F41F 3/042 206/3 |
| 8,414,209 | B2 * | 4/2013 | Forrey | A45D 40/04 401/52 |
| 9,055,793 | B2 * | 6/2015 | Jansen | A44C 27/001 |
| 2005/0167454 | A1 * | 8/2005 | Botero | B65B 61/184 222/556 |

* cited by examiner

*Primary Examiner* — Jacob K Ackun

(57) ABSTRACT

A shotgun shell novelty caddy, comprising: a removable cap(s) element; a shotgun shell brass head end member; a shotgun shell crimp end member; a built-in accessible storage chamber element; a attachment member(s) area; and a non attachment area, a shotgun shell novelty caddy configured so that it is attachable and non-attachable, wherein when a cap is openable and closable via a user, a stored item is easily accessible to the user.

3 Claims, 9 Drawing Sheets

SHOTGUN SHELL NOVELTY CADDY

The present invention relates to a molded cylindrical storage container shotgun shell novelty caddy.

BACKGROUND

Regular shotgun shell novelties do not store items and do not allow a novelty to be attached to caps, hats, backpacks, or just about anything that comes to mind; and, regular shotgun shell novelties do not have a storage chamber with a attachment area allowing it to be held on a magnetically metal surface, such as a refrigerator and other things.

Presently there is no solution for people to carry around a molded shotgun shell storage-able novelty caddy; and, there is no solution to have easy access to items in another convenient way held on a magnetically metal surface.

In U.S. Pat. No. USD641,640 S1 (Jason J. Kraff), a ornamental design for a shotgun shell bottle is disclosed. The device is targeted as a drinking bottle which does not have a attachment area for attaching to caps, hats, backpacks, or just about anything that comes to mind; and, the device being targeted as a drinking bottle does not have a attachment area to be held on a magnetically metal surface.

Another device is disclosed in U.S. Pat. No. US20120039657 A1 (Wayne Stanley Forrey), a shotgun shell lip balm hull is targeted as a cosmetic or personal care product dispenser and not for the storage of items; and, the device does not have an attachment area for attaching to caps, hats, backpacks, or just about anything that comes to mind; and, the device being targeted does not have an attachment area to be held on a magnetically metal surface.

SUMMARY

The present invention seeks to provide a solution to this problem by providing a molded cylindrical storage container shotgun shell novelty caddy, comprising: a removable cap(s) element, a shotgun shell brass head end member, a shotgun shell crimp end member, a built-in accessible storage chamber element, a attachment member area, and a non-attachment member area, a molded cylindrical storage container shotgun shell novelty caddy configured so that when a cap is operable and closable via a user, a stored item is easily accessible to the user.

The present invention seeks to provide a solution by providing a molded cylindrical storage container shotgun shell novelty caddy which can be attached to caps, hats, backpacks, or just about anything that comes to mind; and, it seeks to provide a solution to this problem by providing a molded shotgun shell novelty caddy for easy access to items in areas where there is a magnetic metal surface. The magnetically attractive surface to which the cylindrical storage container is encapsulated is that of a shotgun shell novelty caddy. The present invention can be placed and held on a magnetically metal surface, such as a refrigerator.

In particular, the present invention provides the method for storage with a convenient way to carry around the shotgun shell novelty caddy which can be attached to caps, hats, backpacks, or just about anything that comes to mind. In particular, the present invention provides the method for storage and the magnetic method. In particular, the present invention provides a user easy access to items when it is placed in a pocket, purse, backpack or just about anything that comes to mind.

Preferably, it comes with a cap.

Preferably, it provides a compartment for storage.

Preferably, the attachments area is on the back of the shotgun shell novelty caddy.

The present invention will now be more particularly described, with reference to the accompanying drawings, by way of example only and in no way limiting the scope of the invention, in which.

DETAILED DESCRIPTION

Figure 1:
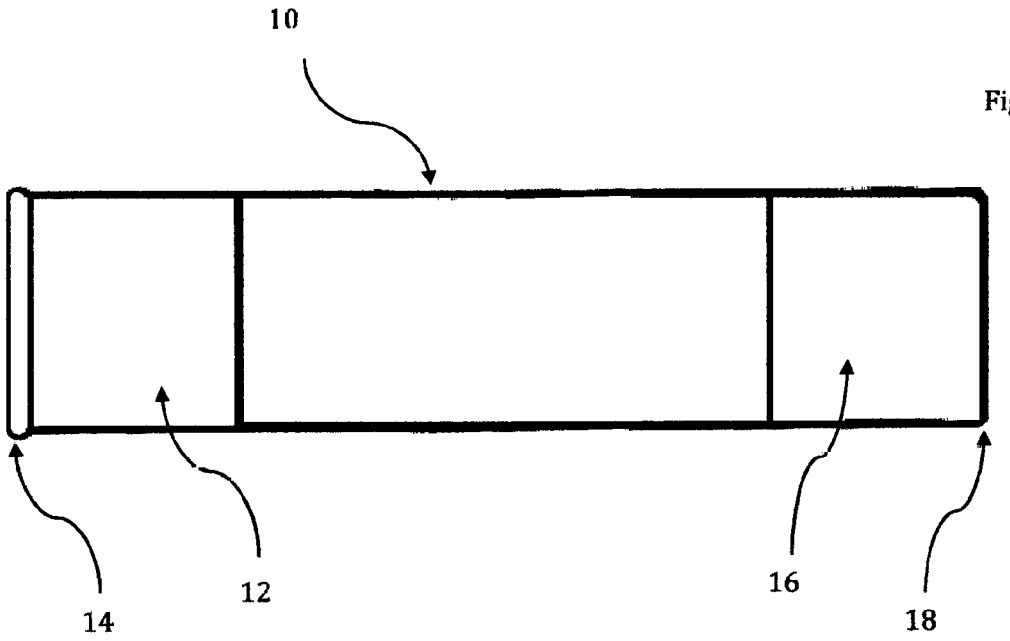
FIG. 1 is a top view of a shotgun shell novelty caddy with a particular reference to a brass head, a brass head end, and a cap configured to resemble a crimp end.
Figure 2:
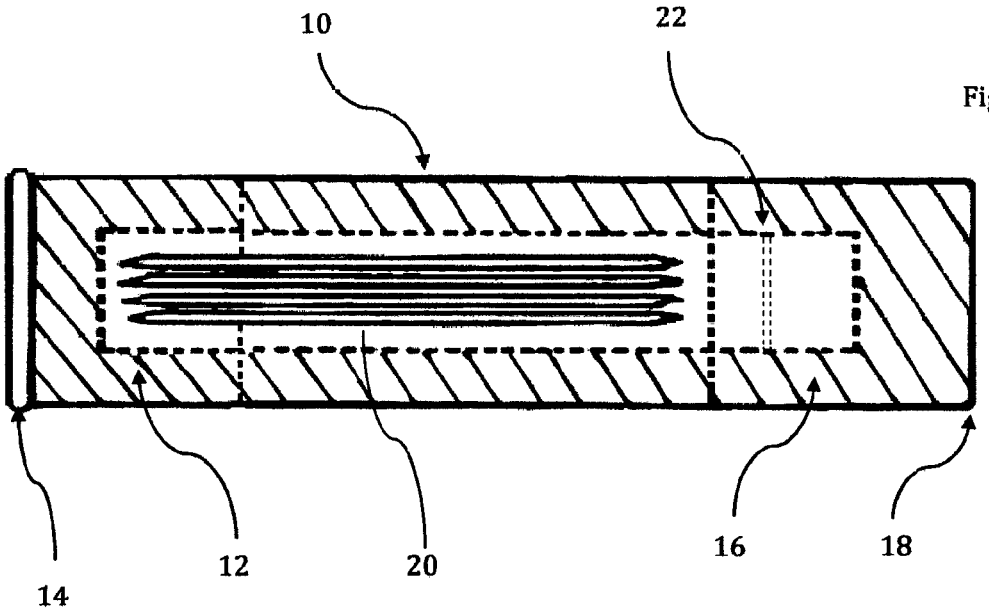
FIG. 2 is a cross-section of the shotgun shell novelty caddy and slip fit pressed on crimp end cap combination of the present invention, in which the storage chamber is filled with toothpicks.
Figure 3:
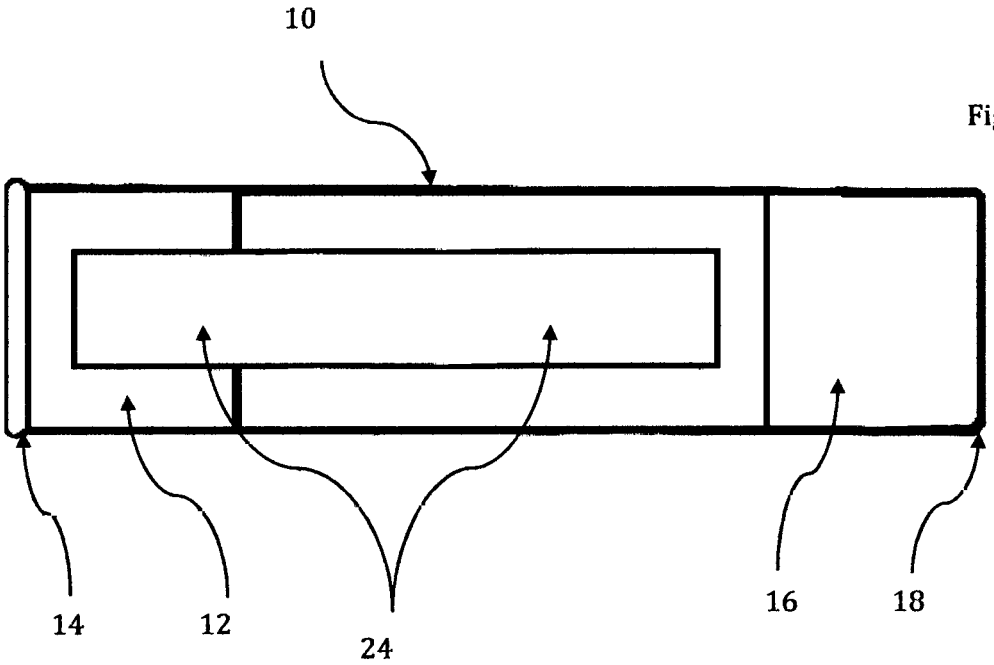
FIG. 3 is a back view of the shotgun shell novelty caddy with particular reference to a attachment(s) area.
Figure 4:
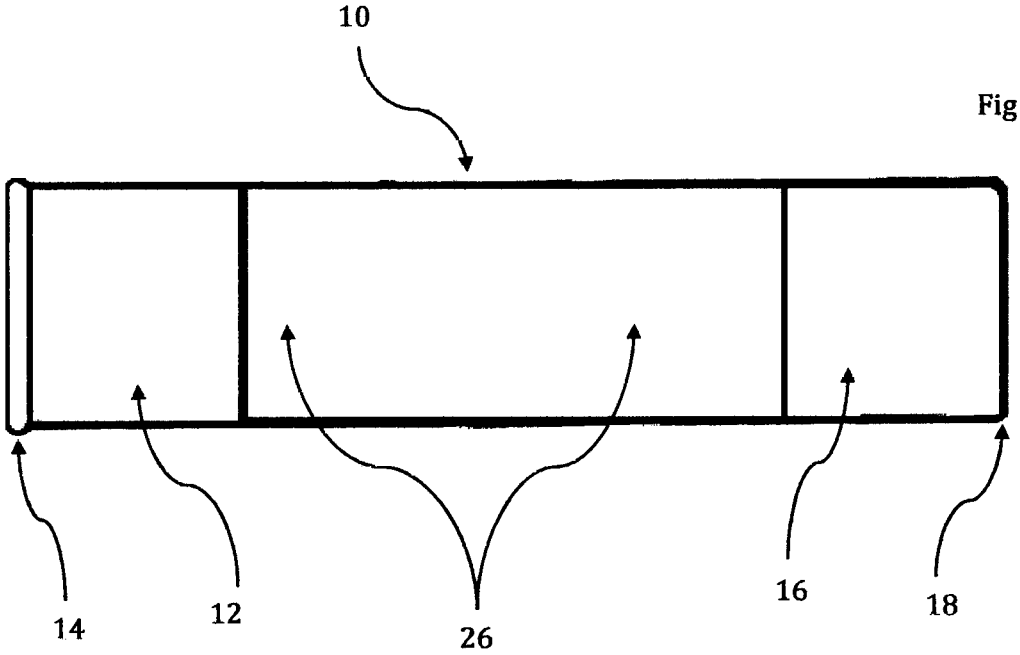
FIG. 4 is a back view of the shotgun shell novelty caddy with particular reference to a no attachment(s) area.
Figure 5:
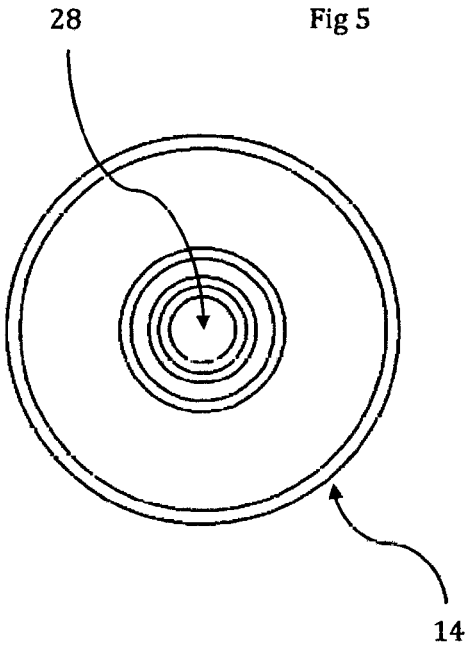
FIG. 5 is a top view of a brass head end with a configured primer.
Figure 6:
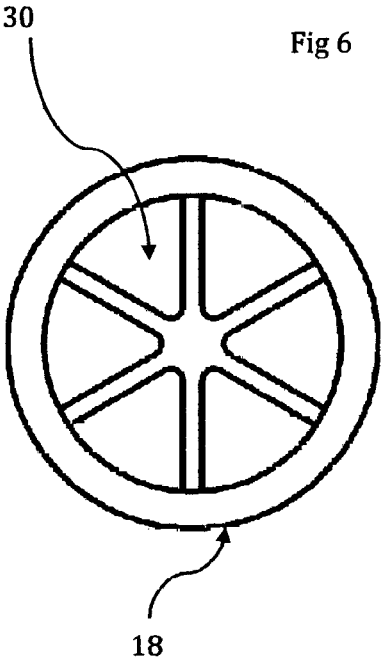
FIG. 6 is a top view of a closed crimp end with configured folds.
Figure 7:
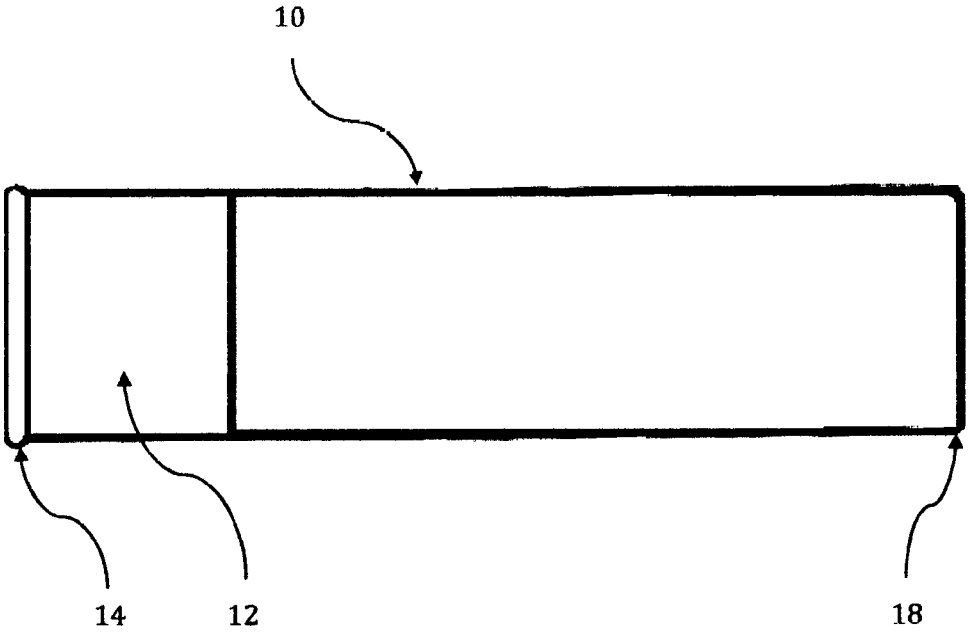
FIG. 7 is a top view of a shotgun shell novelty caddy with a particular reference to a cap configured to resemble a brass head with a brass head end, and a particular reference to a crimp end.
Figure 8:
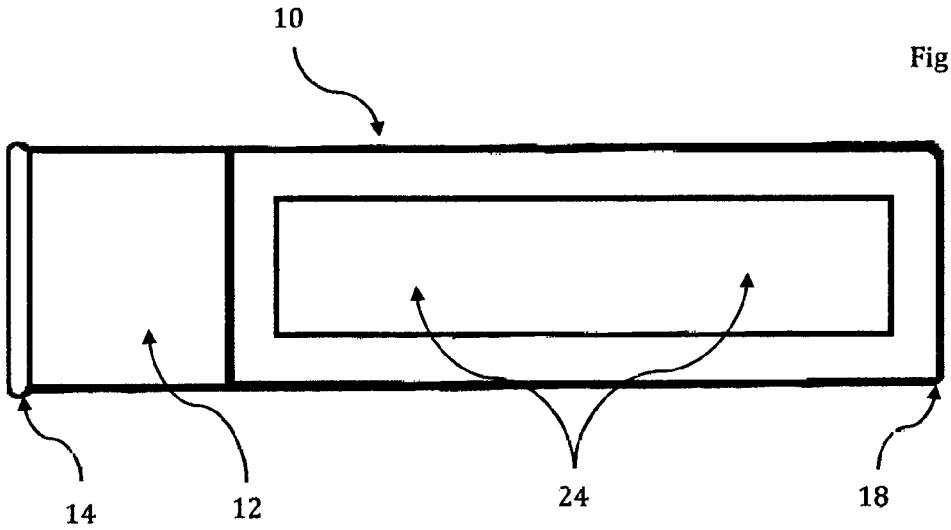
FIG. 8 is a back view of the shotgun shell novelty caddy with a particular reference to a attachments area and a cap configured to resemble the brass head and brass head end.
Figure 9:
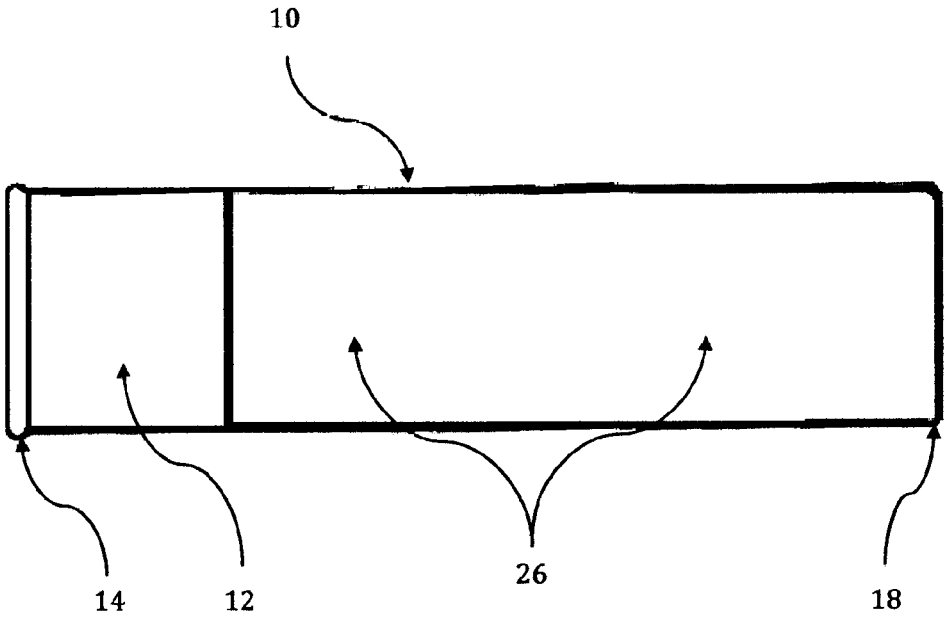
FIG. 9 is a back view of the shotgun shell novelty caddy with a particular reference to a no attachments area and a cap configured to resemble the brass head and brass head end.
Figure 10:
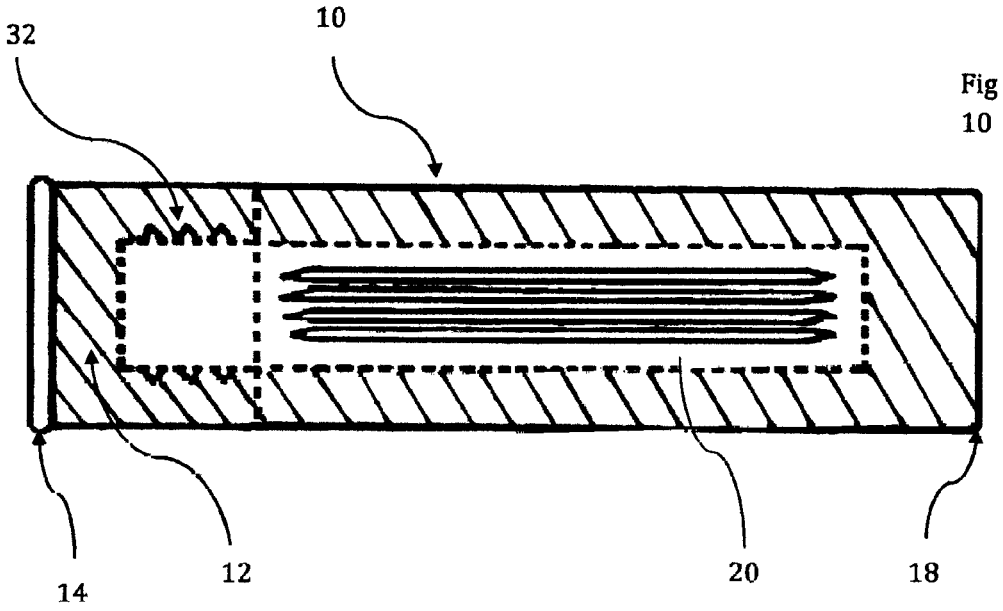
FIG. 10 is a cross-section of the shotgun shell novelty caddy and a threaded brass head with a brass head end cap combination of the present invention, in which the storage chamber is filled with toothpicks.
Figure 11:
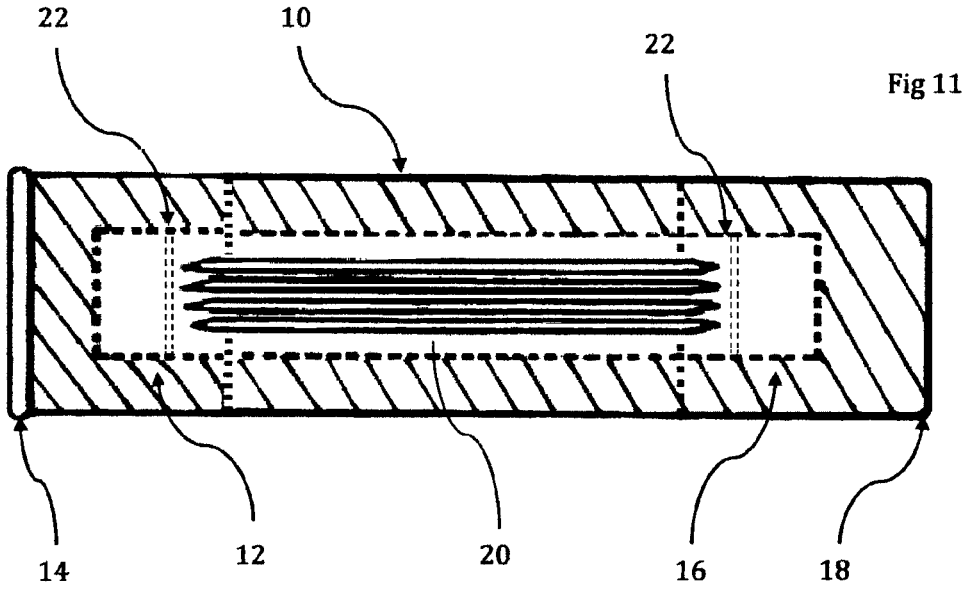
FIG. 11 is a cross-section of one shotgun shell novelty caddy with a slip fit pressed on brass head end cap and a slip fit pressed on crimp end cap combination of the present invention, in which the storage chamber is filled with toothpicks.
Figure 12:
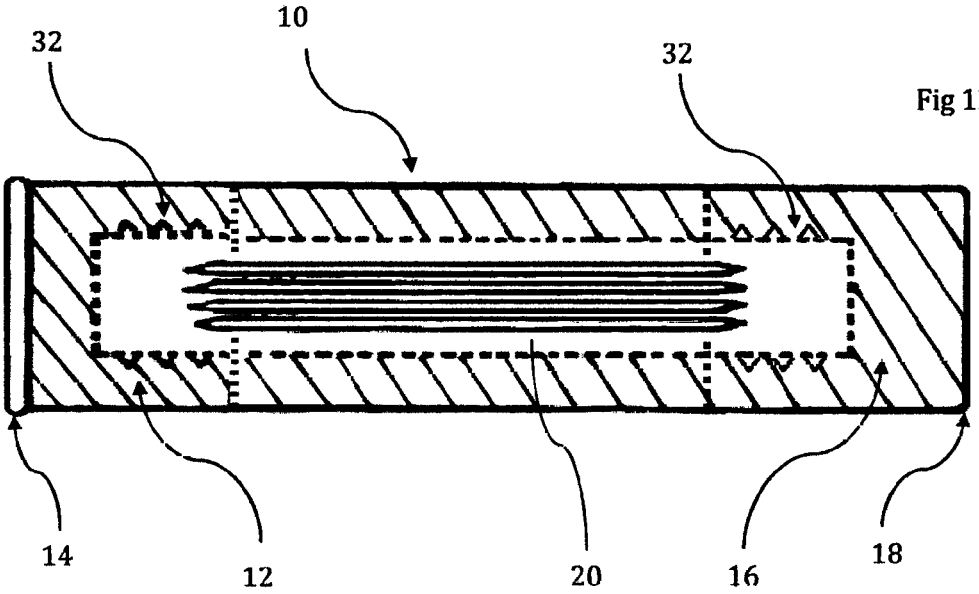
FIG. 12 is a cross-section of one shotgun shell novelty caddy with a threaded brass head end rap and threaded crimp end cap combination of the present invention, in which the storage chamber is filled with toothpicks.
Figure 13:
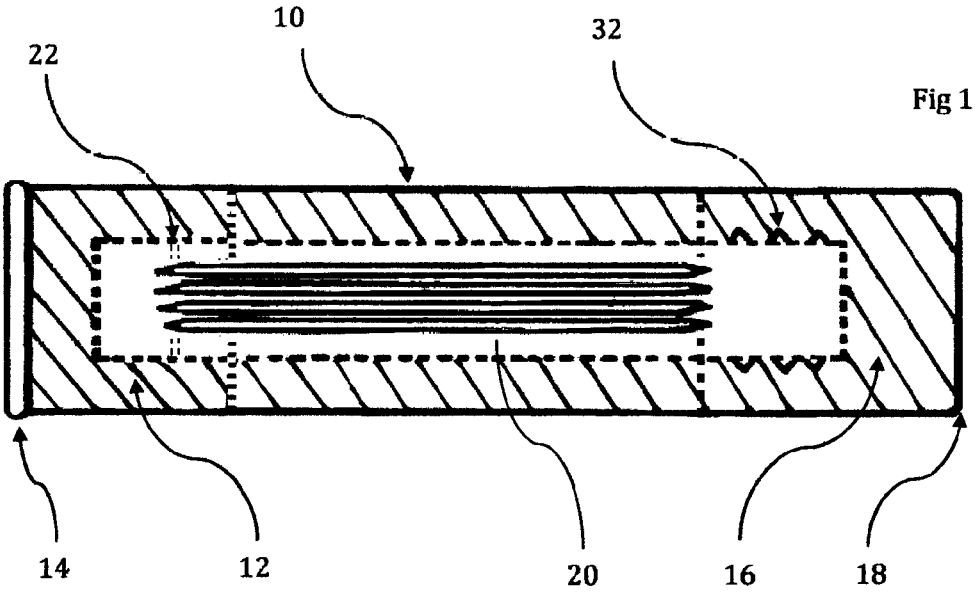
FIG. 13 is a cross-section of one shotgun shell novelty caddy with a slip fit pressed on brass head end cap and threaded crimp end cap combination of the present invention, in which the storage chamber is filled with toothpicks.
Figure 14:
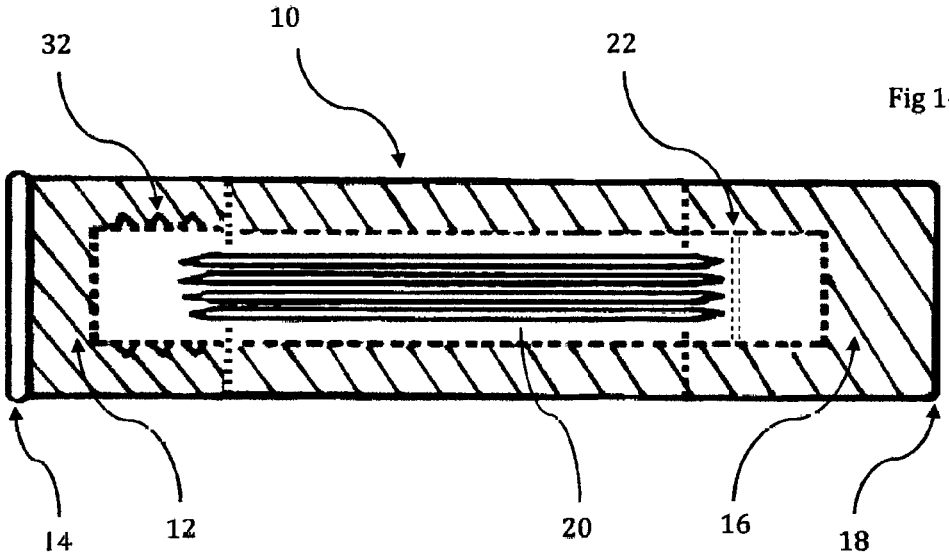
FIG. 14 is a cross-section of one shotgun shell novelty caddy with a threaded brass head end cap and a slip fit pressed on crimp end cap combination of the present invention, in which the storage chamber is filled with toothpicks.
Figure 15:
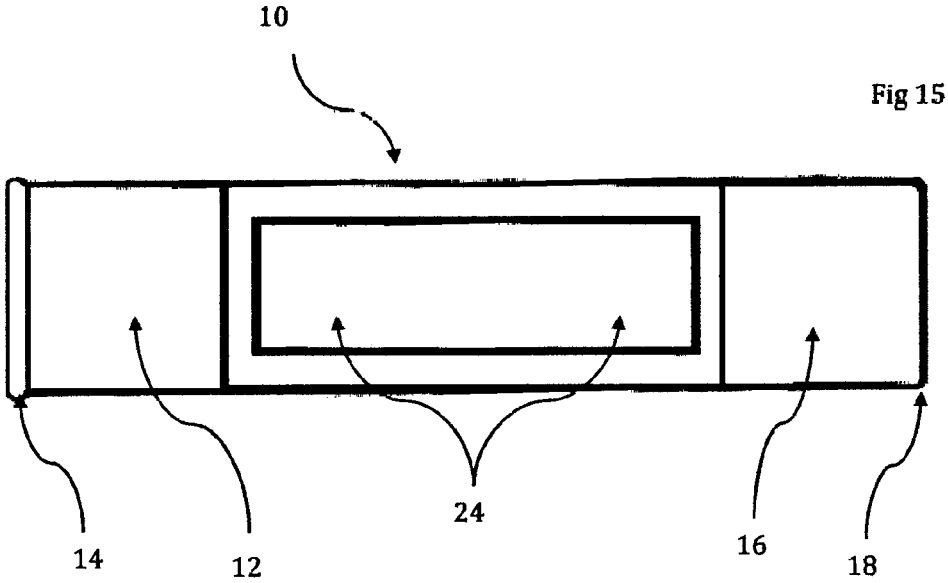
FIG. 15 is a back view of the shotgun shell novelty caddy with a particular reference to a attachments area, a cap configured to resemble the brass head with brass head end and a cap configured to resemble a crimp end.
Figure 16:
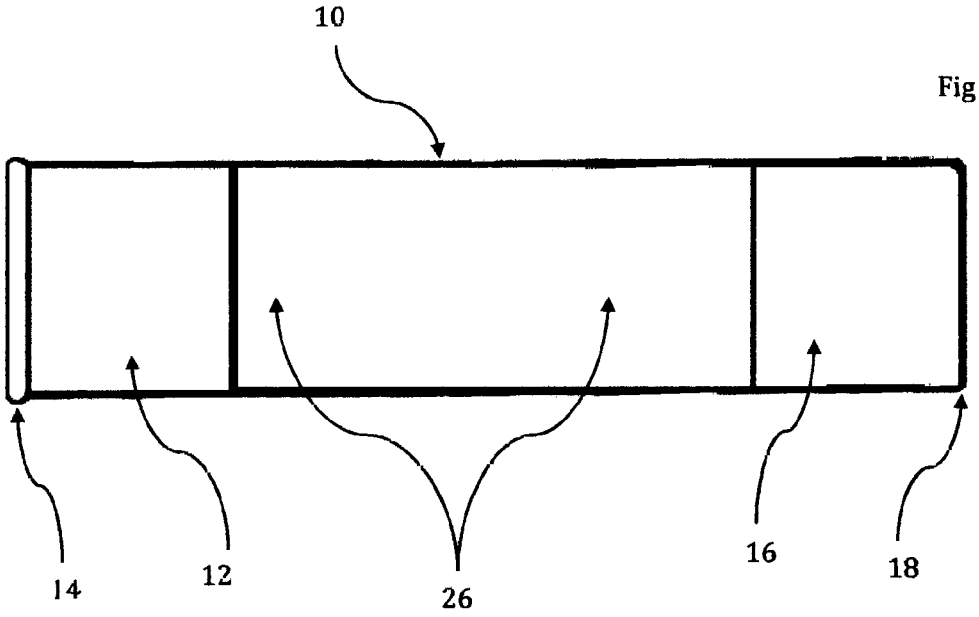
FIG. 16 is a back view of the shotgun shell novelty caddy with a particular reference to a no attachments area, a cap configured to resemble the brass head with brass head end and a cap configured to resemble a crimp end.
Figure 17:
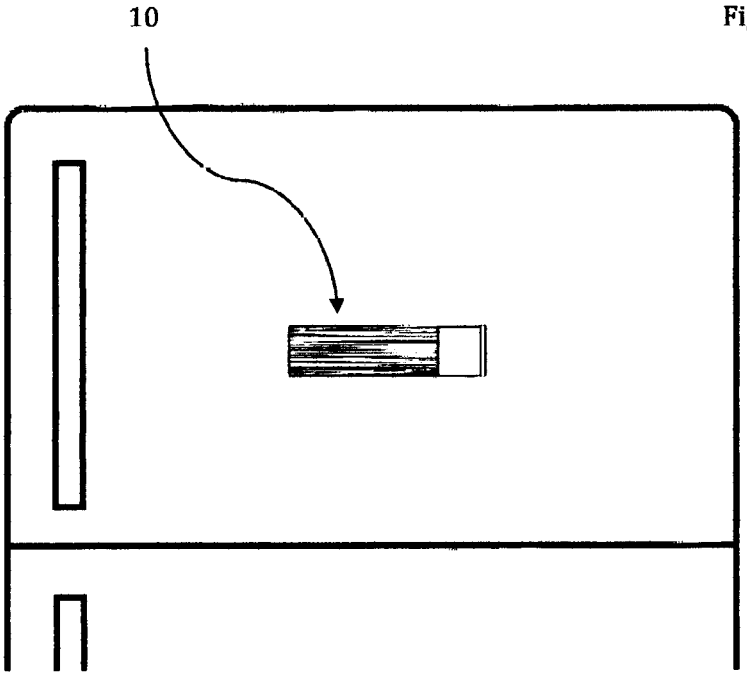
FIG. 17 is a top view of the shotgun shell novelty magnetic caddy on a refrigeration.
Figure 18:
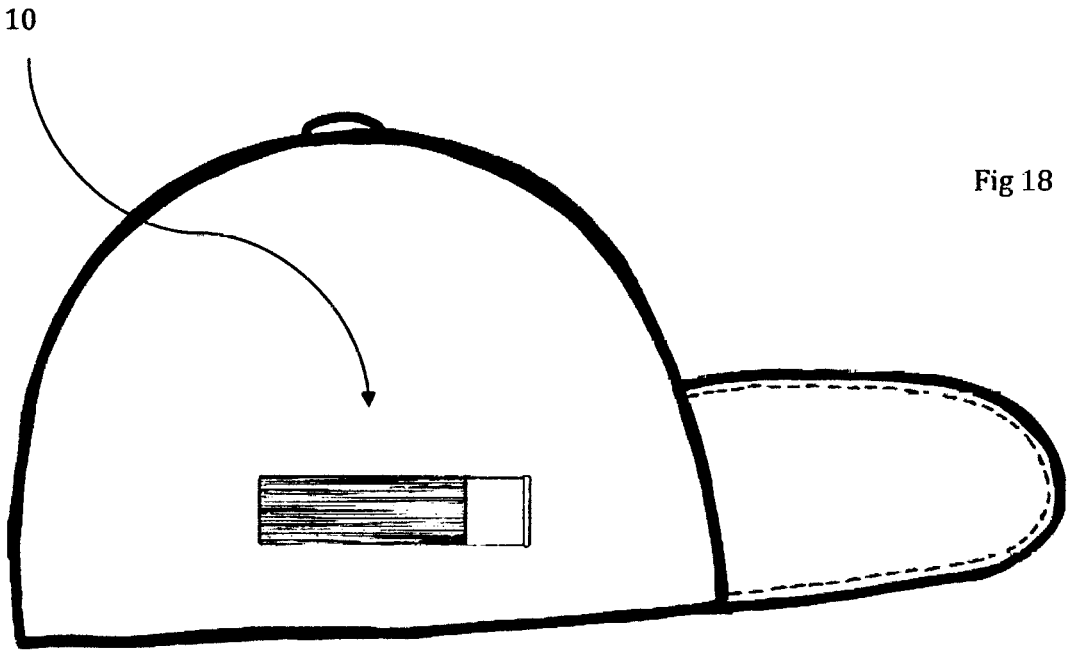
FIG. 18 is a top view of the shotgun shell novelty caddy pinned to a baseball cap.

Referring to the drawings, there is shown a molded cylindrical storage container shotgun shell novelty caddy 10, comprising: a removable molded cap 12 element and a removable cap 16 element; a shotgun shell brass head end 14 member, a shotgun shell crimp end 18 member; a built-in accessible storage chamber 20 element; a attachment member area 24 and a no attachment member area 26; a shotgun shell novelty caddy 10 configured so that it is attachable and not attachable; wherein when a cap 12 element and cap 16 element is openable and closable via a user a stored item is easily accessible to the user.

There is shown a detachable cap 12 configured to resemble the brass head end 14 and is for accessing the storage chamber 20 located within the shotgun shell novelty caddy 10.

The brass head end 14 of the detachable cap 12 there is configured a primer 28 preferably on top.

Referring to the detachable cap 16 configured with a slip fit press on 22 and with the closed crimp end 18 and is for accessing the storage chamber 20 located within the shotgun shell novelty caddy 10.

The crimp end 18 of the detachable cap 16 there is configured closed crimp end folds 30 preferably on top.

The built-in accessible storage chamber 20 is to hold and transport items.

Referring to the slip fit press on 22 is for illustration purposes only.

Referring to the attachments area 24 is for illustration purposes only.

Referring to the no attachments area 26 is for illustration purposes only.

Referring to the threads 32 is for illustration purposes only.

The invention will now be described in use, with reference to a preferred embodiment, in no way limiting a scope of the invention.

In use, when a shotgun shell novelty caddy is attached to a cap, hat, backpack, or just about anything that comes to mind, a user no longer has to go searching for items; when in use such as placed and held on a magnetically metal surface, such as a refrigerator it provides a user easy access to items; and, when in use with no attachments it can be placed in a pocket, purse, backpack or just about anything that comes to mind.

Without the invention the user would have to go looking for the items.

The embodiments described above are provided by way of example only, and various other modifications will be apparent to persons skilled in the art without departing from the scope of the invention as defined in the appended claims.

The invention claimed is:

1. A molded cylindrical storage container shotgun shell novelty caddy, comprising:

a removable molded cap(s) element;

a shotgun shell brass head end member;

a shotgun shell crimp end member;

a built-in accessible storage chamber element to facilitate storage by a user;

a attachment member area for attaching the caddy to an object; and wherein the caddy is configured so that, when a cap is openable and closable via a user, a stored item is easily accessible to the user.

2. The molded cylindrical storage container shotgun shell novelty caddy, as claimed in claim 1, wherein the removable molded cap element is at least one of:

slip fit;

press on;

threaded;

and is configured to facilitate access to the storage chamber element by a user.

3. The molded cylindrical storage container shotgun shell novelty caddy, as claimed in claim 1, wherein the attachment member area, comprises at least one of:

tie tacks;

hook and loop material;

glue;

and magnet(s).

* * * * *